US011796293B2

(12) United States Patent
Carr et al.

(10) Patent No.: US 11,796,293 B2
(45) Date of Patent: Oct. 24, 2023

(54) TELESCOPED AMMUNITION COMPRISING A SHELL

(71) Applicant: CTA INTERNATIONAL, Bourges (FR)

(72) Inventors: Chris Carr, Bourges (FR); Titouan Voillot, Bourges (FR)

(73) Assignee: CTA INTERNATIONAL, Bourges (FR)

( * ) Notice: Subject to any disclaimer, the term of this patent is extended or adjusted under 35 U.S.C. 154(b) by 39 days.

(21) Appl. No.: 17/624,688

(22) PCT Filed: Jul. 6, 2020

(86) PCT No.: PCT/FR2020/000198
§ 371 (c)(1),
(2) Date: Jan. 4, 2022

(87) PCT Pub. No.: WO2021/001607
PCT Pub. Date: Jan. 7, 2021

(65) Prior Publication Data

US 2022/0252381 A1 Aug. 11, 2022

(30) Foreign Application Priority Data

Jul. 4, 2019 (FR) ..... 1907438

(51) Int. Cl.
*F42B 12/28* (2006.01)
*F42B 5/045* (2006.01)
*F42B 14/06* (2006.01)

(52) U.S. Cl.
CPC ..... *F42B 12/28* (2013.01); *F42B 5/045* (2013.01); *F42B 14/06* (2013.01)

(58) Field of Classification Search
CPC ..... F42B 12/22; F42B 12/24; F42B 12/28; F42B 5/045; F42B 5/184; F42B 5/185
See application file for complete search history.

(56) References Cited

U.S. PATENT DOCUMENTS 2,413,008 A * 12/1946 Taglialatela ..... F42B 12/28 102/389
2,798,431 A * 7/1957 Semon ..... F42B 12/28 102/495
3,482,516 A * 12/1969 Ruth ..... F42B 5/184 102/433
3,566,794 A * 3/1971 Pearson ..... F42B 12/22 102/493
3,677,183 A * 7/1972 Talley ..... F42B 12/22 102/495
3,731,630 A * 5/1973 Muller ..... F42B 12/06 89/36.02
3,820,464 A * 6/1974 Dixon ..... F42B 12/22 102/493

(Continued)

*Primary Examiner* — Derrick R Morgan
(74) *Attorney, Agent, or Firm* — Oliff PLC

(57) ABSTRACT

A telescoped ammunition formed of a shell integrated into a case closed by a rear end cap, the shell includes a nose cone, a body made of a heavy material followed by a cage, wherein the body of the shell is formed of an internal part and an external part, the internal part being tubular in shape and having embrittlement grooves the external part being arranged to press on the internal part and formed of a stack of discs, each disc having embrittlement grooves.

9 Claims, 3 Drawing Sheets

(56) References Cited

U.S. PATENT DOCUMENTS

| | | | | | |
|---|---|---|---|---|---|
| 4,106,411 | A * | 8/1978 | Borcher | F42B 12/22 | 102/495 |
| 4,312,274 | A * | 1/1982 | Zernow | F42B 12/22 | 102/493 |
| 4,745,864 | A * | 5/1988 | Craddock | F42B 12/22 | 102/493 |
| 4,770,098 | A * | 9/1988 | Stoner | F42B 5/045 | 102/466 |
| 4,782,758 | A * | 11/1988 | Washburn | F42B 5/045 | 102/434 |
| 4,899,661 | A * | 2/1990 | Kaelin | F42B 12/28 | 102/495 |
| 6,129,024 | A * | 10/2000 | Gerber | F42B 12/64 | 102/521 |
| 6,619,210 | B1 * | 9/2003 | Spivak | F42B 12/32 | 102/493 |
| 6,962,113 | B1 * | 11/2005 | Carlson | F42B 12/22 | 102/389 |
| 8,061,275 | B1 * | 11/2011 | Gold | F42B 12/32 | 102/493 |
| 8,161,884 | B1 * | 4/2012 | Kokodis | F42B 12/24 | 102/493 |
| 8,276,520 | B1 * | 10/2012 | Fong | F42B 12/22 | 102/493 |
| 9,212,876 | B1 * | 12/2015 | Kostka | F42B 12/22 | |
| 11,118,865 | B2 * | 9/2021 | Pigott | F42B 12/64 | |
| 2003/0145756 | A1 * | 8/2003 | Eches | F42B 14/061 | 102/523 |
| 2005/0235862 | A1 * | 10/2005 | Gousman | F42B 12/76 | 102/493 |
| 2017/0097216 | A1 * | 4/2017 | Sullivan | F42B 10/00 | |
| 2022/0373312 | A1 * | 11/2022 | Carr | F42B 12/62 | |

* cited by examiner

TELESCOPED AMMUNITION COMPRISING A SHELL

SCOPE OF THE INVENTION

The technical scope of the present invention is that of telescoped ammunition of large and medium caliber, namely shells and in particular anti-air shells.

STATE OF THE ART

Telescoped ammunition has been commonly used in military equipment for several years, in particular to supply cannons. Their major advantages with respect to classical ammunition is their reduced weight for equal performance.

In the scope of shells, telescoped ammunition may namely be anti-tank ammunition, explosive ammunition, practice ammunition or anti-air ammunition.

This is complex high-technology ammunition whose complexity has increased over time. In the specific case of known anti-air ammunition known as "airburst" ammunition which designates shells functioning with a timer fuze, the main problem is to generate a cloud of fragments that is as predictable as possible so as to have a reproducible forecasting model of possible outcomes.

So as to pursue this objective, many architectures of dispersible parts or fragments have been envisaged and implemented over time, such as, for example:

U.S. Pat. No. 5,817,969 which discloses a shell of which part of the body is formed by sub-projectiles.

Patent DE-3153378 which discloses a shell whose body is formed of an assembly of discs between which a metallic powder is inserted.

These two documents illustrate specific configurations in which the incorporation of the sub-projectiles is initially foreseen.

PRESENTATION OF THE INVENTION

The purpose of the invention is to propose an airburst anti-air shell design providing an effective and predictable dispersion of the debris.

The architecture of the present ammunition provides the shell with a cloud of projectiles whose dimensions and dispersion further to the explosion of the charge are both predictable and reproducible taking into account the inevitable margins for error.

The invention thus relates to telescoped ammunition formed of a shell integrated into a case closed by a rear end cap, said shell comprising a nose cone, a body made of a heavy material followed by a cage, the body of said shell being formed of an internal part and an external part, the internal part being tubular in shape and having embrittlement grooves and the external part being arranged to press on the internal part and formed of a stack of discs, each disc having embrittlement grooves.

According to one characteristic of the telescoped ammunition, the embrittlement grooves on the internal part are made longitudinally from the exterior to the interior and the grooves in the external part are made longitudinally from the interior to the exterior.

According to another characteristic of the telescoped ammunition, the external part is of a length that is less than that of the internal part.

According to yet another characteristic of the telescoped ammunition, the heavy material constituting the body is tungsten.

According to yet another characteristic of the telescoped ammunition, the nose cone is arranged pressing on the internal part of the body and the cage is arranged pressing on the internal part, said cage enclosing a timer fuze.

According to yet another characteristic of the telescoped ammunition, the external profile of the external part is aligned with that of the nose cone and the cage.

According to yet another characteristic of the telescoped ammunition, the internal part is provided at the front with an external machined part to receive the nose cone and at the rear with an internal bore in which to insert a pyrotechnic igniter.

According to yet another characteristic of the telescoped ammunition, the internal part is provided at the front with a plug.

According to yet another characteristic of the telescoped ammunition, the case is formed of three sabots joined by at least one embrittled fastening means.

According to yet another characteristic of the telescoped ammunition, the fastening means are formed by a retaining ring.

According to yet another characteristic of the telescoped ammunition, the latter is a sub-calibre anti-air shell with an airburst function.

One advantage of the ammunition according to the invention lies in the fact that the shell is in the form of a solid part that is ballistically perfectly stable and does not comprise any sub-projectiles.

Another advantage of the ammunition according to the invention lies in its ease of implementation by associating this solid part with a nose cone and rear part which gives it a ballistic profile without further action.

Yet another advantage of the present invention lies in the fact that the shell is stable on its trajectory after firing.

Yet another advantage of the present invention lies in the fact that the shell may be easily integrated into its case without the need for complex procedures.

The projectile does not need a structural body intended to carry a pellet load. The ratio of useful mass to total mass is therefore optimized.

DESCRIPTION OF THE DRAWINGS

Other characteristics, advantages and particulars of the invention will be better understood from the additional description given hereafter by way of illustration and in relation to the appended drawings, in which.

DETAILED DESCRIPTION OF THE EMBODIMENTS OF THE INVENTION

Figure 1:
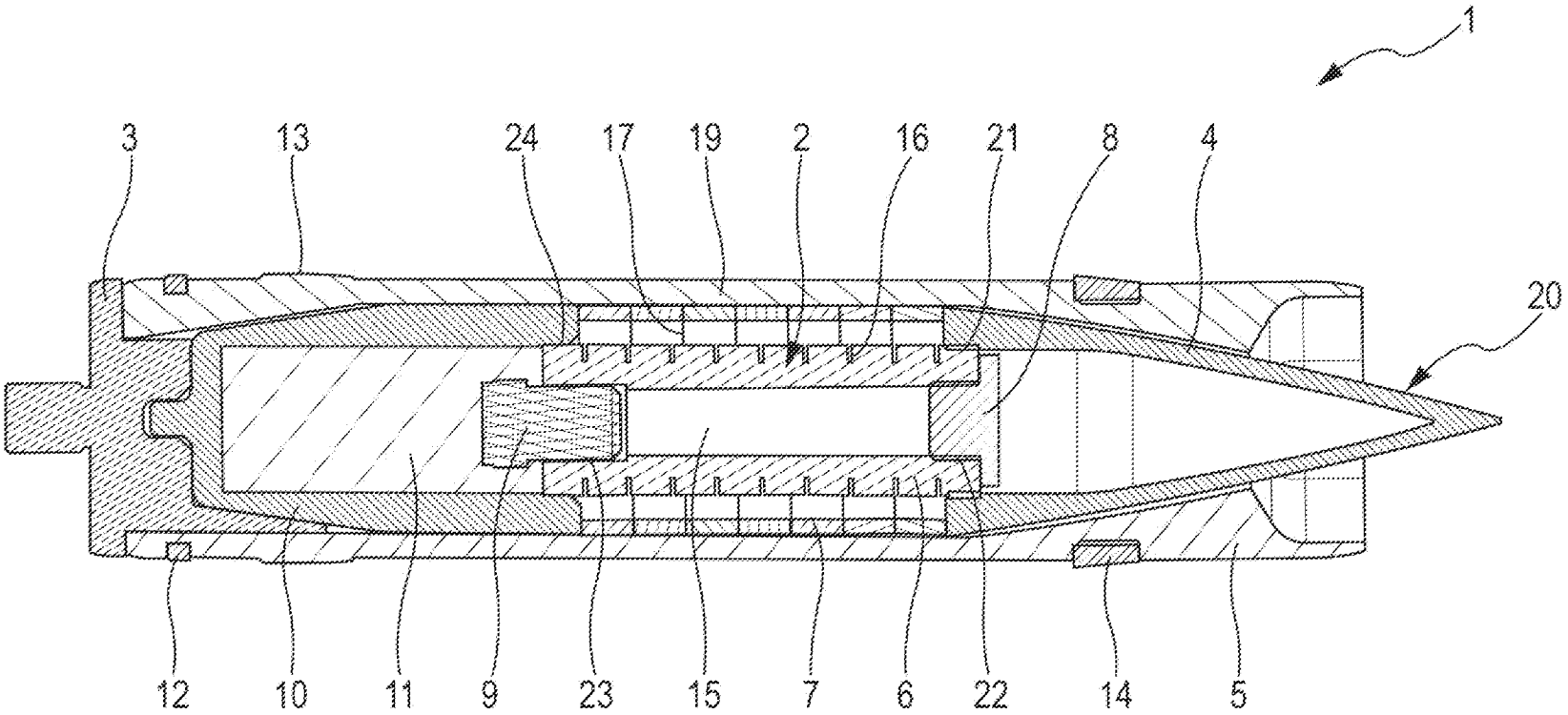
FIG. 1 is a longitudinal section of telescoped ammunition according to a first embodiment of the invention.

FIG. 1 shows a first embodiment of the telescoped ammunition 1 according to the invention.

As can be seen, this ammunition 1 is formed of a shell 20 comprising a body 2, a rear end cap 3 and a nose cone 4, this assembly being incorporated into a case 19 or sabot classically formed of three parts 5.

The body 2 is formed of a tubular internal part 6 and an external part 7. This internal part 6 is in the form of a tubular part enclosing an explosive composition 15. The internal part 6 is closed at the front by a plug 8, fastened in an internal bore 22 made at its front end, and to the rear by a pyrotechnic igniter 9, screwed into an internal bore 23 made at its rear end. This internal part 6 is also provided around its external circumference with zones of embrittlement in the form of embrittlement grooves 16 made from the exterior to the interior.

The explosive composition 15 is a pyrotechnic charge intended to explode in flight in order to cause the dislocation of the internal and external parts of the shell as will be explained hereafter.

Figure 3:
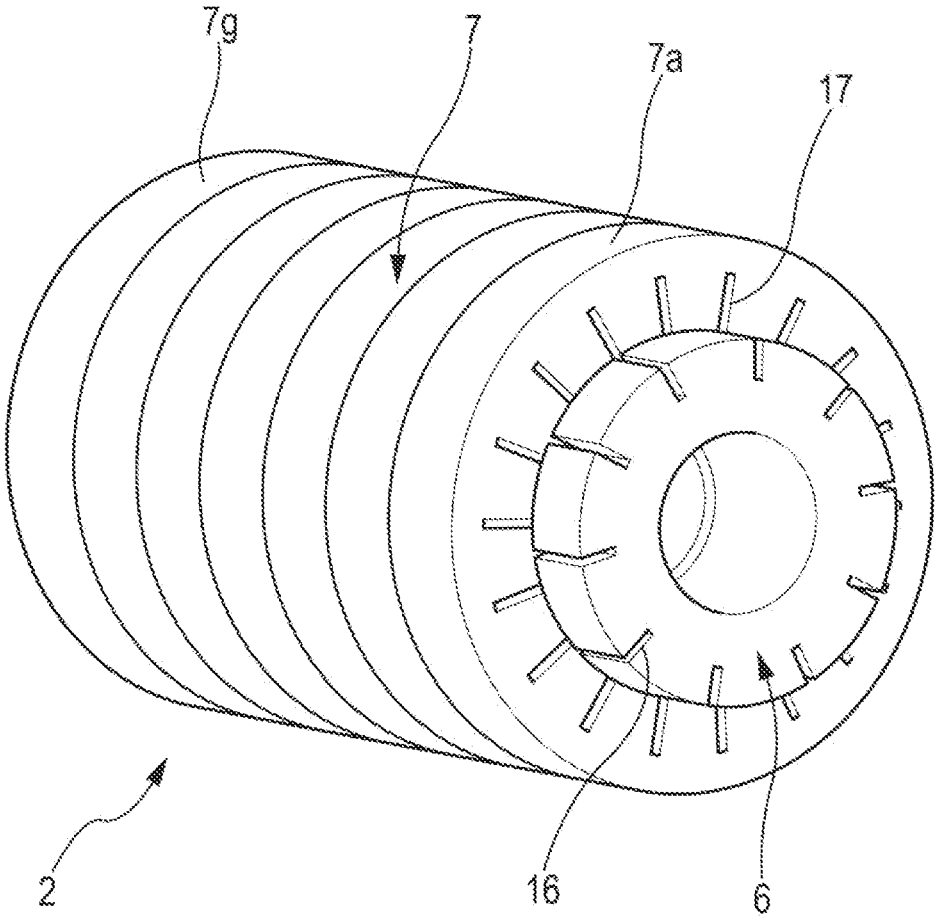
FIG. 3 is a perspective view of the central body of the ammunition according to the invention.

The external part 7 is constituted by discs 7 stacked around the internal part 6. The discs have longitudinal embrittlement grooves along their internal surface as can be seen in FIG. 3. These discs 7 are held in position at the front by the nose cone 4 and at the rear by the cage 10. The nose cone and cage are force fitted tightly to the external machined zones 21 and 24 made respectively at the front and rear ends of the internal part 6. Thus, the nose cone 4 presses against the first disc 7 and the cage 10 presses against the last disc 7.

The cage 10 is substantially cylindrical in shape and contains a timer fuze 11 fixed in alignment with the pyrotechnic igniter 9 which is intended to ignite the explosive composition 15 after a certain delay.

The sabots 5 are classically held together at the rear by an embrittled retaining ring 12 and at the front by a sliding band 14, both intended to break upon exiting the launch tube.

Figure 2:
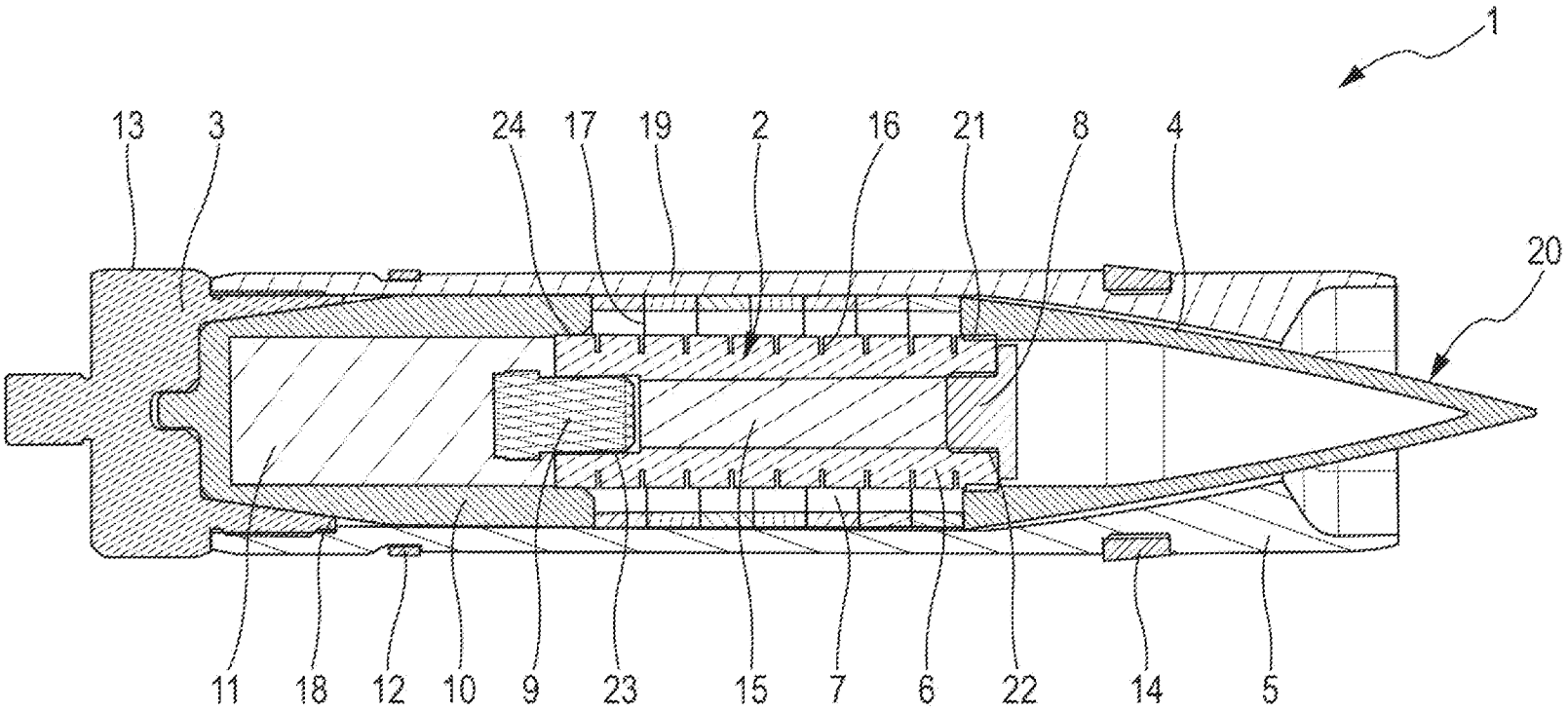
FIG. 2 is a longitudinal section of telescoped ammunition according to a second embodiment of the invention.

FIG. 2 shows a longitudinal section of another embodiment of the ammunition 1. The overall structure is the same as for the embodiment shown in FIG. 1, and the same elements are referenced by the same numbers.

In this embodiment, it can be seen that the rear end cap 3 has a different structure in that it has a seal 18 on top of the cage and closely pressing on the case 19.

FIG. 3 shows a perspective view of the body 2 of the ammunition 1. It shows the tubular internal part 6 with its longitudinal external grooves 16.

It also shows the external part 7 surrounding the internal part 6, formed of the discs 7, here 7*a* to 7*g*. The discs 7 have longitudinal embrittlement grooves 17 along their internal walls.

The telescoped ammunition 1 functions as follows.

Upon firing, the ammunition 1 is launched and upon exiting the barrel, the air intake in the front funnel-shaped end of the sabots 5 subjects the embrittled fastening means 12 to stress that causes it to rupture thereby releasing the shell 2 from the case formed by the three sabots 5.

The shell contains a timer fuze 11 which is initiated and whose function is programmed to prime the composition 15 after a certain delay. Triggering the time fuze 11 contained in the cage 10 ignites the pyrotechnic igniter 9 which causes the explosive composition 15 to detonate. The subsequent explosion causes the dislocation of the body 2 into a cluster of very high-velocity fragments. Given that these are heavy fragments, there is a very high capacity for destruction of the intended targets.

Since the ammunition 1 is anti-air ammunition, the cloud of fragments is particularly effective in the destruction of ammunition in flight. However, the original structure of the ammunition 1 according to the invention enables the production of fragments of predetermined size and shape, therefore producing a predictable and reproducible dispersion.

It can easily be understood that the ammunition 1 described enables the bursting of the body 2 constituted by the internal and external 7 parts into regular fragments of shapes predetermined by the lines of embrittlement 16 and 17. Thus, the ammunition 1 has a predictable and constant fragment cloud effect ensuring a more easily extrapolatable destruction of the intended target.

Additionally, the use of telescoped ammunition enables the weight of the ammunition to be reduced without reducing its range, which is a known advantage of telescoped ammunition. Lastly, the fact of providing a solid body enables the projectile's ballistics to be better controlled and thus the functioning reliability and firing accuracy to be improved.

The invention claimed is:

1. A telescoped ammunition, comprising:

a case; and a shell integrated into the case closed by a rear end cap, the shell comprising:

a nose cone, and a body made of a heavy material followed by a cage, wherein:

the body of the shell is formed of an internal part and an external part, the internal part is tubular in shape and having has embrittlement grooves, the external part is arranged to press on the internal part and the external part is formed of a stack of discs, each disc having embrittlement grooves, the case is formed of three sabots joined by at least one embrittled fastening means, and the fastening means are formed by a retaining ring.

2. The telescoped ammunition according to claim 1, wherein the embrittlement grooves on the internal part are made longitudinally from the exterior to the interior and the embrittlement grooves in the external part are made longitudinally from the interior to the exterior.

3. The telescoped ammunition according to claim 1, wherein the external part is of a length that is less than that of the internal part.

4. The telescoped ammunition according to claim 1, wherein the heavy material constituting the body is tungsten.

5. The telescoped ammunition according to claim 1, wherein the nose cone is arranged pressing on the internal part of the body and the cage is arranged pressing on the internal part, the cage enclosing a timer fuze.

6. The telescoped ammunition according to claim 1, wherein the external profile of the external part is aligned with that of the nose cone and the cage.

7. The telescoped ammunition according to claim 1, wherein the internal part is provided at the front with an external machined part to receive the nose cone and at the rear with an internal bore in which to insert a pyrotechnic igniter.

8. The telescoped ammunition according to claim 7, wherein the internal part is provided at the front with a plug.

9. The telescoped ammunition according to claim 1, wherein the ammunition is a sub-calibre anti-air shell with an airburst function.

* * * * *